United States Patent [19]

Stjernstrom

[11] 3,936,225

[45] Feb. 3, 1976

[54] DIAGONAL IMPELLER PUMP

[75] Inventor: Bo Gustaf Stjernstrom, Tyreso, Sweden

[73] Assignee: ITT Industries, Inc., New York, N.Y.

[22] Filed: May 1, 1974

[21] Appl. No.: 465,785

[30] Foreign Application Priority Data

May 9, 1973 Sweden ..... 7306490

[52] U.S. Cl. ..... 415/207; 415/210; 415/215; 415/501; 417/424 R

[51] Int. Cl.[2] ..... F04D 1/04; F04D 29/26

[58] Field of Search ..... 415/501, 207, 215, 210; 417/424 R

[56] References Cited

UNITED STATES PATENTS

| | | | |
|---|---|---|---|
| 1,408,715 | 4/1922 | Seelig et al. | 415/215 |
| 1,509,653 | 9/1924 | Kaplan | 415/215 |
| 1,981,991 | 11/1934 | Cline et al. | 415/501 |
| 2,043,236 | 6/1936 | Conant | 417/424 R |
| 2,055,587 | 9/1936 | Pigott | 415/215 |
| 2,189,767 | 2/1940 | Vose | 415/215 |
| 2,233,825 | 3/1941 | Walsh et al. | 415/215 |
| 2,647,467 | 8/1953 | Davis | 415/215 |
| 2,991,927 | 7/1961 | Quick | 415/215 |
| 3,102,679 | 9/1963 | Rudy | 415/215 |
| 3,163,119 | 12/1964 | Huppert et al. | 415/215 |
| 3,168,048 | 2/1965 | Toyokura et al. | 415/207 |

*Primary Examiner*—Henry F. Raduazo
*Attorney, Agent, or Firm*—John T. O'Halloran; Menotti J. Lombardi, Jr.; Peter Van Der Sluys

[57] ABSTRACT

A pump is provided with a stationary impeller housing having a motor driven diagonal impeller mounted therein. A diffuser is mounted coaxially with the impeller for converting the kinetic energy of the pumped fluid into a pressure head. A hollow body mounted in the diffuser defines a diffuser passage in which curved diffuser blades are mounted. The impeller has a conical hub having a diameter equal to 40–80 percent of the maximum diameter of the impeller blades.

2 Claims, 4 Drawing Figures

DIAGONAL IMPELLER PUMP

BACKGROUND OF THE INVENTION

1. Field of the Invention

The present invention relates to a fluid pump and more particularly to a pump having an axially aligned impeller and diffuser.

2. Description of the Prior Art

The pump device of the present invention is intended, among other things, for use as a submersible pump. Different types of submersible pumps are known to the art, although these pumps are generally centrifugal pumps, i.e. pumps having a centrifugal impeller. Although these known pump constructions have been found very effective and reliable in operation, the largest cross dimension or largest outer diameter of the pump must, of necessity, be relatively large, since the radial flow of the impeller makes it necessary to provide a deflecting unit, which means that the outer diameter of the pump must be increased. Further, in many instances, the pump housing must be provided with a hose connecting stub in the form of a curved pipe, which also increases the cross dimensions of the pump.

SUMMARY OF THE INVENTION

The main object of the present invention is to circumvent at least substantially the aforementioned disadvantages and to provide a novel type of pump which does not require a diameter-increasing deflectin unit and whose hose connection can have the form of an axially extending stub located at the outlet end of the diffuser. The principle construction of the pump shall also be such that its drive motor may be either an electric motor or a hydraulic motor. It shall also be possible to integrate the pump with one or more similar devices to form a multi-stage type pump unit.

These objects are obtained with a pump device constructed in accordance with the invention, which is characterized in that the impeller comprises a hollow hub provided with radial, curved blades, the outer edges of which lie in an imaginary surface of circular cylindrical configuration or an imaginary surface which is slightly conical in the direction of flow of the pumped medium, and which hub is so constructed that its cross sectional area increases from the inlet side (suction side) of the impeller to the outlet side thereof, the outer diameter of the hub at the inlet side reaching to between 40% and 80% of the maximum outer diameter of the impeller, i.e. the maximum outer diameter of the imaginary cylindrical surface, and in that the diffuser unit comprises a substantially conical diffuser housing which converges in the direction of flow of the pumped medium and which has arranged therein a hollow central body provided with radial, curved guide vanes by means of which the central body is held supported centrally in the diffuser unit, the diffuser passage being formed by the circular space between the outer surface of the central body and the inner surface of the diffuser unit.

With a pump device constructed in this manner the pumped medium obtains a substantially axial main flow direction and the flow is effected with a high energy output and only a small degree of deflection, thereby achieving that wear on the pump as a result of the curved flow path of the fluid particles can be kept at a very low level. The reason why a diagonal impeller having a relatively large hub which diverges in the direction of the impeller axis is to be preferred to a purely axial impeller (i.e. propeller type impeller) is, inter alia, because these latter impellers do not provide a sufficiently high pressure head. When the drive motor has the form of an axial piston type hydraulic motor arranged beneath the impeller unit on the suction side thereof the favorable effect is obtained whereby the axial force generated by the hydraulic motor is directed upwardly and thus counteracts the downwardly acting axial force of the impeller on the motor shaft.

Owing to, among other things, the field of use envisaged for the pump device of the present invention, taking into consideration such factors as the desired pressure head, the extent of wear on the pump caused by the particles carried by the pump liquid etc., the special design of the impeller, and in particular the design of the impeller blades, may vary quite considerably within the scope of the invention. The special design of the impeller is also dependent on such factors as whether the impeller hub and the blades shall be made in one piece or shall comprise joined elements made from different materials, and whether a certain structural design of, for example, the blades is necessary with respect to the method in which the blades are manufactured. These and other factors mean, among other things, that the angle of incidence of the blades at the inlet edge and the outlet edge thereof may differ quite considerably. It is probable that in many cases an impeller will be used whose blades are so curved relative to the longitudinal direction of the blades that the outlet edge angle will be considerably greater than the inlet edge angle. Thus, in accordance with one feature of the invention the angle between a plane extending perpendicular to the pump axis and a plane extending tangential to the impeller blades is between one and four times larger at the outlet edge of the blades than at the inlet edge thereof, preferably between two and three times larger at the outlet edge than at the inlet edge. In this respect, the outlet edge angle may be between 15° and 90° and is preferably approximately 45°, while the inlet edge angle is between 10° and 30°, preferably approximately 15°, while the guide vanes of the diffuser unit have an inlet edge angle of between 30° and 60°, preferably 45°, and an outlet edge angle of between 75° and 105°, preferably 85°.

With pumps provided with rotating impellers, such as with the pump of the present invention, the load acting on the peripheral portions of the blades in particular, i.e. the load acting on the region of the free peripheral edge of the blades in the vicinity of the inside of the impeller housing, tend to create problems with respect to sealing and pressure distribution. To diminish these problems to the greatest possible extent, it is endeavored to collect the particles accompanying the pumped medium in a central flow path, thereby to relieve the load on the peripheral portions of the blades. When using single-curved blades, it is possible, if the loading and trailing edges of the blades converge at least slightly towards the hub to obtain an effect substantially corresponding to that which can be obtained by curving the blades radially, to give a more central flow path. Such chamfering of the blades in this manner creates a certain geometrical fault in the leading edge of the blade, wherewith the blade is forced to work with a mean angle, but since the impeller is of conical shape this fault can be reduced to a minimum. It has been found that such a mean angle does not greatly impair the result even when used with purely cylindrical impellers. In accordance with another feature of the invention the inlet edge and the outlet edge of the impeller blades lie in a plane diametrical to the impeller. The inlet edge of the impeller blades, i.e. the leading edge, is swept slightly rearwardly, the outlet edge of the impeller blades, i.e. the trailing edge, preferably lying in a plane diametrical to the impeller. Thus, in this way, undesirable flow patterns over the blades are counteracted.

In certain instances, it may be convenient to design the impeller blade so that the curved portion begins at a distance along the blade whereby the blade presents a leading inlet portion whose angle of incidence is substantially the same as that at the inlet edge. Thus, in accordance with another feature of the invention, the impeller blades may be so designed that, when seen in a longitudinal section concentric with the imaginary cylindrical surface, they present a straight inlet portion which merges into a circular arcuate outlet portion, the length of the inlet portion reaching to between one-fourth and two-thirds of the total length of the inlet portion and the outlet portion.

When using a single-curved blades, such blades can be manufactured by relatively simple methods. The blades can also be manufactured to advantage as separate elements which are attached to an impeller hub.

It may also be mentioned that the guide vanes of the diffusor unit are designed in consideration of essentially the same factors as those determining the design of the impeller blades. Of course, other optimal values are applicable for, for example, the inlet edge angles and the outlet edge angles of the vanes. Thus, the inlet edge angle of the diffusor vanes $\beta_3$ (FIG. 1), i.e. the angle between a plane perpendicular to the axis of the pump device and a plane at the inlet edge of the vane tangential to the surface thereof should lie between 30° and 60° and is preferably 45°, while the outlet edge angle $\beta_4$ (FIG. 1) (at the trailing edge of the blades) should be between 75° and 105°, and is preferably 85°. That portion of the length of the diffusor guide vanes which can be made straight, i.e. given a constant angle of incidence, may at most only reach to half the length of the vane, but can, of course be considerably shorter. According to yet another feature of the invention the impeller blades are so constructed that the intersection between the blade surface and any diametrical plane to the impeller cutting the blades forms a straight line which is preferably perpendicular to the impeller shaft.

The invention will now be described more in detail with reference to an embodiment thereof illustrated in the accompanying drawing, further features of the invention being made apparent in connection therewith.

DESCRIPTION OF THE INVENTION

Figure 1:
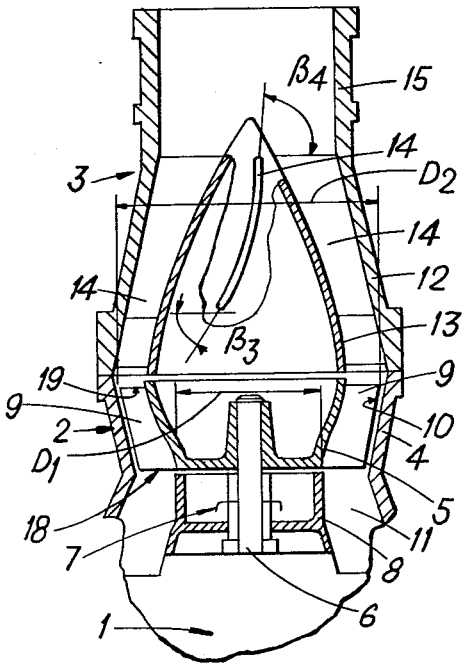
FIG. 1 is a partial, longitudinal sectional view through a pump device according to the invention.

The pump device shown in FIG. 1 comprises three coaxially arranged main components, namely a drive motor 1, an impeller unit 2 and a diffusor unit 3. Neither the type of drive motor used or its location relative to the impeller and diffusor unit are restrictive to the invention, and the motor may be a hydraulic motor or an electric motor for example. With the illustrated embodiment, the motor is placed on the suction side of a the impeller unit, although the motor may also be arranged downstream of the diffusor unit, the motor shaft in this latter instance passing, of course, through the diffusor unit. With the illustrated embodiment, the motor is assumed to be hydraulic motor.

The impeller unit 2 comprises a stationary, conical impeller housing 4 in which there is arranged for rotation a conical diagonal impeller 5 which is supported and driven by a drive shaft 6 extending from the motor 1. In a region upstream of the impeller 5, the shaft 6 is provided in a conventional manner with a suitable sealing means 7 arranged within a surrounding housing 8. The impeller 5 comprises a hollow hub having radial, curved blades 9, the outer edges 10 of which lie on a conical, imaginary cylindrical surface, the largest outer diameter of which is shown by the reference $D_2$. The outer diameter of the impeller hub at the inlet side is shown by the reference $D_1$. The primary characteristic feature of the invention is that the diameter $D_1$ at the inlet side reaches to between 40% and 80% of the maximum diameter $D_2$ of the imaginary cylindrical surface defined by the outer edges of the blades. The pumped medium is sucked by the impeller via an inlet (not shown) into a circular chamber 11 around the housing 8 and is then accelerated by the impeller blades 9 in a helical path up towards the inlet side of the diffusor unit. A portion of the kinetic energy of the pumped liquid is converted in the diffusor in a conventional manner into useful pressure energy.

The stationary diffusor unit 3 comprises a diffusor housing 12 which converges in the flow direction of the liquid and which has arranged therein a hollow central body 13 having radial, curved guide vanes 14, the central body being held centered in the diffusor unit by means of said vanes. The pump housing 4 and the diffusor housing are joined together by bolt joints for example. The diffusor housing is provided at its downstream end with a substantially circular outlet portion 15, to which a hose or pipe can be connected.

As previously mentioned, the design of the impeller and diffusor should be selected each time in dependence of the different parameters applicable to the use to which the pump device is to be put. The factors on which the design of the impeller and diffusor is decided has been discussed in the general portion of the description, and hence only a few of the characteristic properties of the illustrated impeller will be mentioned here.

Figure 2:
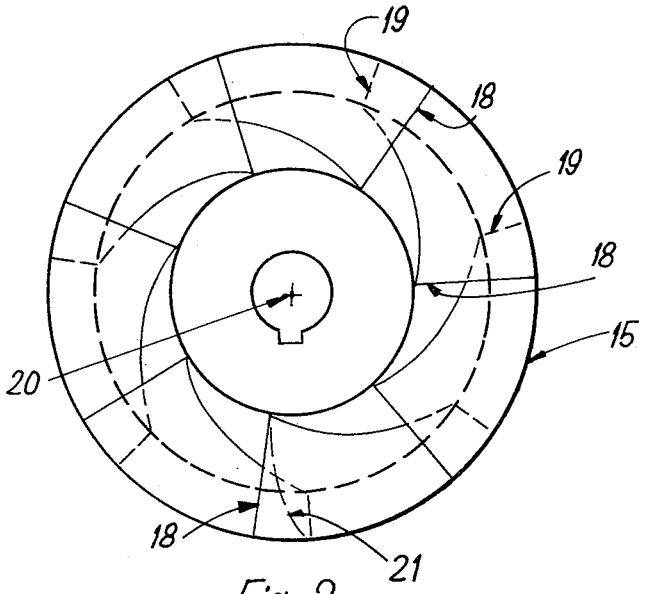
FIG. 2 is an end view of an impeller seen from the suction side.
Figure 3:
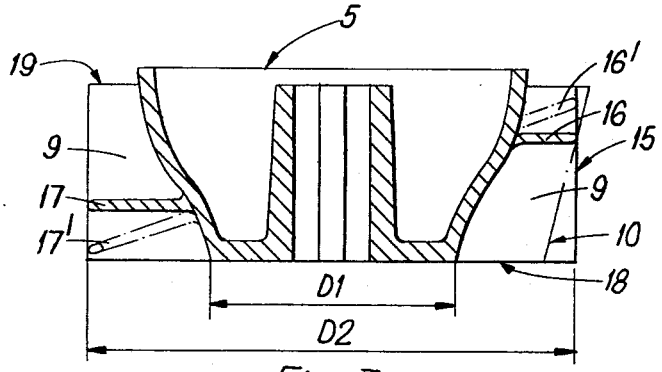
FIG. 3 is a diametrical sectional view through the impeller shown in FIG. 2.

FIGS. 2 and 3 show an impeller having a cylindrical surface shape. The portions of the impeller identical with the impeller shown in FIG. 1 are identified with the same reference numerals. It should be observed that the impeller of the embodiment shown in FIGS. 2 and 3 mainly differs from the impeller shown in FIG. 1 by the fact that the surface contour 15 is cylindrical, while the surface contour of the impeller in FIG. 1 is conical (e.f. the contour 10 shown in dash lines). The pump blades 9 of the impeller shown in FIGS. 2 and 3 are single-curved, i.e. have a radial cross section which is parallel with a plane extending at right angles to the impeller axis. If the blades were double-curved instead, the radial cross sections could, for example, present the section profiles shown at 16' and 17' respectively (FIG. 3). As will be seen from FIG. 2, the inlet edges 18 of the blades and their outlet edges 19 lie in a plane diametrical to the impeller axis. There is nothing to prevent, however, either or both of said edges from being directed so that extensions of said edges pass to one side of the center point shown at 20. Neither need the edges be straight, but may be swept rearwardly, which is to be preferred in some cases. A blade having a rearwardly swept leading edge is shown in chain-dotted lines 21 in FIG. 2.

Figure 4:
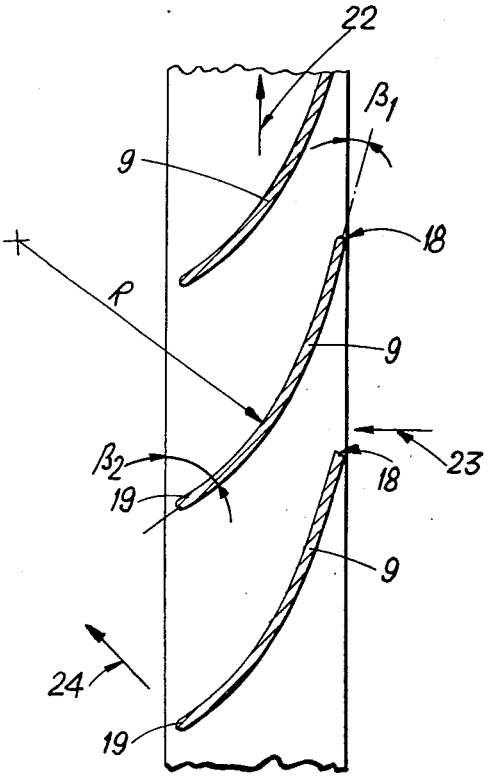
FIG. 4 is a conical section through the blades of an impeller developed in plane.

FIG. 4 illustrates the configuration of a conical section through the blades of the impeller in FIGS. 2 and 3 when it is developed in plane. As will be seen from the Figure, the angle of incidence $\beta_1$ of the blades at the inlet edge 18 is smaller than the angle of incidence $\beta_2$ at the outlet edge 19. Suitable values for these angles have been given in the aforegoing and are found recited in the claims. The blades shown in FIG. 4 are of such shape that the leading edge of the blades is substantially flat while the edge is arcuate, with a radium R. The dimensions of the straight portion of the blades have been mentioned in the aforegoing and are found recited in the following claims. The direction of rotation of the impeller is shown by the reference numeral 22 in FIG. 4, and the arrows 23 and 24 respectively show the approximate flow direction of the pumped medium relative the inlet edge and the outlet edge respectively.

It will be understood that the illustrated design of the different components of the pump device are only shown by way of example and that the particular design of each separate component depends upon the desired performance of the pump, the medium to be pumped, the material from which the pump components are made and the manner in which respective components are manufactured.

What is claimed is:

1. An improved pump of the type wherein there is provided an impeller unit having a stationary conical impeller housing, a motor driven impeller rotatably coupled in said housing, and a stationary diffuser unit which extends coaxially with said impeller housing at the outlet side of said impeller, and wherein said impeller comprises a hollow hub having a cross-section which increases from the inlet side of the impeller to the outlet side thereof, the hub outer diameter at the inlet side ranging between 40% and 80% of the maximum outer diameter of said impeller, and wherein the diffuser unit comprises a substantially conical diffuser housing which converges in the flow direction of the pumped medium and which has arranged therein a hollow central body said impeller comprises:

a plurality of radial curved blades on said hollow hub, the outer edges of which lie in a conical imaginary surface in the direction of flow such that the angle between a plane extending at right angles to the pump shaft and a plane tangential to said impeller blades at the outlet edge of the blades lies between 15° and 90° while the corresponding angle at the inlet edge of the blades lies between 10° and 30°; and a plurality of radial curved guide vanes for holding said central body centered in the diffuser housing, said guide vanes having an inlet angle between 30° and 60° and an outlet edge angle between 75° and 105°.

2. An improved pump of the type wherein there is provided an impeller unit having a stationary conical impeller housing, a motor driven impeller rotatably coupled in said housing, and a stationary diffuser unit which extends coaxially with said impeller housing at the outlet side of said impeller, and wherein said impeller comprises a hollow hub having a cross-section which increases from the inlet side of the impeller to the outlet side thereof, the hub outer diameter at the inlet side ranging between 40% and 80% of the maximum outer diameter of said impeller, and said diffuser unit comprises a substantially conical diffuser housing which converges in the flow direction of the pumped medium and which has arranged therein a hollow central body wherein said impeller comprises:

a plurality of radial curved blades on said hollow hub, the outer edges of which lie in conical imaginary surface in the direction of flow such that the angle between a plane extending at right angles to the pump shaft and a plane tangential to said impeller blades at the outlet edge of the blades is 45° while the corresponding angle at the inlet edge of the blades is 15°; and a plurality of radial curved guide vanes for holding said central body centered in the diffuser housing, said guide vanes having an inlet angle 45° and an outlet edge angle of 85°.

* * * * *